US009090103B2

(12) United States Patent
Sakano

(10) Patent No.: US 9,090,103 B2
(45) Date of Patent: Jul. 28, 2015

(54) RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 325 days.

(21) Appl. No.: 13/072,858

(22) Filed: Mar. 28, 2011

(65) Prior Publication Data

US 2011/0242188 A1 Oct. 6, 2011

(30) Foreign Application Priority Data

Mar. 31, 2010 (JP) ..... 2010-081328

(51) Int. Cl.

| | |
|---|---|
| ***B41J 29/393*** | (2006.01) |
| ***B41J 11/00*** | (2006.01) |
| ***B41J 13/00*** | (2006.01) |
| *B41J 2/01* | (2006.01) |

(52) U.S. Cl.
CPC ..... *B41J 11/006* (2013.01); *B41J 13/0045* (2013.01)

(58) Field of Classification Search
USPC ..... 347/19, 101, 104
See application file for complete search history.

(56) References Cited

U.S. PATENT DOCUMENTS

| | | | | |
|---|---|---|---|---|
| 4,990,966 | A * | 2/1991 | Sindo | 399/124 |
| 5,333,852 | A * | 8/1994 | Milillo et al. | 271/171 |
| 5,615,001 | A * | 3/1997 | Kawashima et al. | 399/226 |
| 5,987,279 | A * | 11/1999 | Ebata | 399/113 |
| 6,125,251 | A * | 9/2000 | Shiraishi et al. | 399/124 |
| 6,134,404 | A * | 10/2000 | Iwai et al. | 399/110 |
| 6,145,828 | A * | 11/2000 | Arai | 271/3.03 |
| 6,647,223 | B2 * | 11/2003 | Ishii | 399/90 |
| 6,722,647 | B2 * | 4/2004 | Kato et al. | 271/3.03 |
| 6,788,910 | B2 * | 9/2004 | Kida | 399/124 |
| 7,031,640 | B2 * | 4/2006 | Komoda et al. | 399/124 |
| 7,386,255 | B2 * | 6/2008 | Ochi | 399/121 |
| 7,418,220 | B2 * | 8/2008 | Shiraishi et al. | 399/110 |
| 7,445,330 | B2 * | 11/2008 | Kudoh et al. | 347/108 |

(Continued)

FOREIGN PATENT DOCUMENTS

| | | | |
|---|---|---|---|
| CN | 1618617 | A | 5/2005 |
| CN | 101254713 | A | 9/2008 |

(Continued)

OTHER PUBLICATIONS

JP Decision to Grant a Patent dated Mar. 6, 2012, corresponding Application No. 2010-081328; EnglishTranslation.

(Continued)

*Primary Examiner* — Jannelle M LeBron
*Assistant Examiner* — Jeremy Bishop
(74) *Attorney, Agent, or Firm* — Banner & Witcoff, Ltd.

(57) ABSTRACT

A recording apparatus includes a recording unit, a conveying unit disposed below the recording unit, a return path unit configured to return the recording medium from the upstream side of the recording unit to the conveying unit, and a casing. The return path unit is disposed below the conveying unit and includes a horizontal conveying path including an upper portion and a lower portion. The side walls of the casing include a drawing port through which the conveying unit and a least the upper portion of the horizontal conveying path are drawn out, and an opening facing in a direction perpendicular to the drawing direction thereof. The inner edge of the lower end of the opening is positioned the same or lower in height than the uppermost portion of the horizontal conveying path in the return path unit.

22 Claims, 9 Drawing Sheets

(56) References Cited

U.S. PATENT DOCUMENTS

| | | | | |
|---|---|---|---|---|
| 7,596,341 | B2 * | 9/2009 | Yokoi | 399/124 |
| 7,715,757 | B2 * | 5/2010 | Tanaka et al. | 399/124 |
| 7,731,353 | B2 * | 6/2010 | Kudoh et al. | 347/108 |
| 7,883,087 | B2 * | 2/2011 | Kitano | 271/258.01 |
| 8,157,262 | B2 * | 4/2012 | Sakano | 271/275 |
| 8,251,507 | B2 * | 8/2012 | Sugimoto et al. | 347/108 |
| 2008/0075503 | A1 | 3/2008 | Tanaka et al. | |
| 2008/0205954 | A1 | 8/2008 | Sugiyama et al. | |
| 2009/0218761 | A1 | 9/2009 | Sakano | |

FOREIGN PATENT DOCUMENTS

| | | | |
|---|---|---|---|
| JP | 10-091053 | | 4/1998 |
| JP | 10-333384 | | 12/1998 |
| JP | 11-038711 | | 2/1999 |
| JP | HEI 11-052647 | A | 2/1999 |
| JP | 2002-323833 | | 11/2002 |
| JP | 2003-122072 | A | 4/2003 |
| JP | 2003-287991 | A | 10/2003 |
| JP | 2007-033645 | A | 2/2007 |
| JP | 2009-241355 | | 10/2009 |

OTHER PUBLICATIONS

JP Office Action mailed Nov. 8, 2011, JP Appln. 2010-081328, partial English translation.

Office Action with Search Report issued in corresponding Chinese Patent Application No. 201110078887.2, mailed May 28, 2013.

* cited by examiner

RECORDING APPARATUS

CROSS REFERENCE TO RELATED APPLICATION

The present application claims the priority from Japanese Patent Application No. 2010-081328 filed Mar. 31, 2010, the entire subject matter and disclosure of which is incorporated herein by reference.

BACKGROUND OF THE INVENTION

1. Field of the Invention

The present invention relates to a recording apparatus including a recording unit that records an image on a recording medium and a conveying unit that conveys the recording medium to the recording unit.

2. Description of the Related Art

A known recording apparatus having a duplex printing function accommodates a recording unit, a conveying unit, a return path unit, a paper cassette, etc, in a casing. In single-sided printing, paper stacked in the paper cassette is conveyed to the recording unit by the conveying unit, and an image is printed on one side of the paper by the recording unit. In duplex printing, paper on which an image is recorded by the recording unit is returned to the side of the conveying unit upstream of the recording unit through the return path and is conveyed again to the recording unit, and an image is recorded also on the other side. If a paper jam occurs in a region between the recording unit and the conveying unit, the jammed paper was removed by hand. However, the manual work was not easy because the region is not wide enough for the hand to be inserted.

Thus, various technologies for simplifying jam handling have been proposed. For example, Japanese Unexamined Patent Application Publication No. 10-333384 (Paragraph [0028]) discloses a technology for ensuring a workspace for jam handling between the recording unit and the conveying unit by inclining the conveying unit in the casing. However, this technology needs a space in the casing for inclining the conveying unit, which poses the problem of increasing the size of the casing.

Thus, as disclosed in Japanese Unexamined Patent Application Publication No. 10-91053 (FIGS. 8 and 10), the conveying unit is drawn out of the casing together with paper placed on the holding surface thereof.

Since the technology described above needs no space in the casing for the conveying unit to be inclined, an increase in the size of the casing may be prevented. However, when the conveying unit is drawn out of the casing, paper placed on the holding surface is sometimes caught in the recording unit or the like to be left in the casing, thus posing the problem of difficulty in removing the paper.

SUMMARY OF THE INVENTION

The present invention is made in view of the background art described above. Accordingly, it is an object of the present invention to provide a recording apparatus in which a jammed recording medium may be removed while an increase in the size of the casing is prevented, and in which even if a recording medium is left in the casing, the recording medium may easily be removed.

According to one embodiment described herein, a recording apparatus includes a recording unit configured to record an image on a recording medium. The recording apparatus includes a conveying unit disposed below the recording unit and configured to convey the recording medium to a position at which recording is performed by the recording unit. The recording apparatus includes a return path unit configured to return the recording medium to the side of the conveying unit upstream of the recording unit to record an image again on the recording medium. The recording apparatus includes a casing which accommodates the recording unit, the conveying unit, and the return path unit. The return path unit is disposed below the conveying unit and includes a horizontal conveying path including an upper portion and a lower portion. Side walls of the casing includes a drawing port through which the conveying unit and at least the upper portion of the horizontal conveying path are drawn out, and an opening facing in a direction perpendicular to the drawing direction thereof. The inner edge of the lower end of the opening is positioned the same or lower in height than the uppermost portion of the horizontal conveying path in the return path unit.

With this configuration, since a jammed recording medium is taken out of the casing together with the conveying unit etc., the recording medium may easily be removed at the outside of the casing. Furthermore, the opening is formed to face in the direction perpendicular to the drawing direction of the conveying unit etc. Accordingly, even if a recording medium is left in the casing when the conveying unit etc. are drawn out, the recording medium may easily be removed by inserting a hand into the casing through the opening.

Since at least the upper portion of the horizontal conveying path is drawn out together with the conveying unit, and since the inner edge of the lower end of the opening is positioned the same or lower in height than the uppermost portion of the horizontal conveying path, a wide space into which the hand is inserted may be provided in the casing, thus allowing the recording medium left in the casing to be effectively removed.

Thus, a jammed recording medium may easily be removed while preventing an increase in the size of the casing. Furthermore, even if the recording medium is left in the casing, the recording medium may easily be removed by inserting a hand into the casing through the opening.

DETAILED DESCRIPTION OF EMBODIMENTS

Recording apparatuses according to embodiments of the present invention will be described hereinbelow with reference to the drawings. Although the following embodiments use paper P as a "recording medium", a plastic sheet and so on may be used instead of the paper P.

[Overall Configuration of Recording Apparatus]

Figure 1:
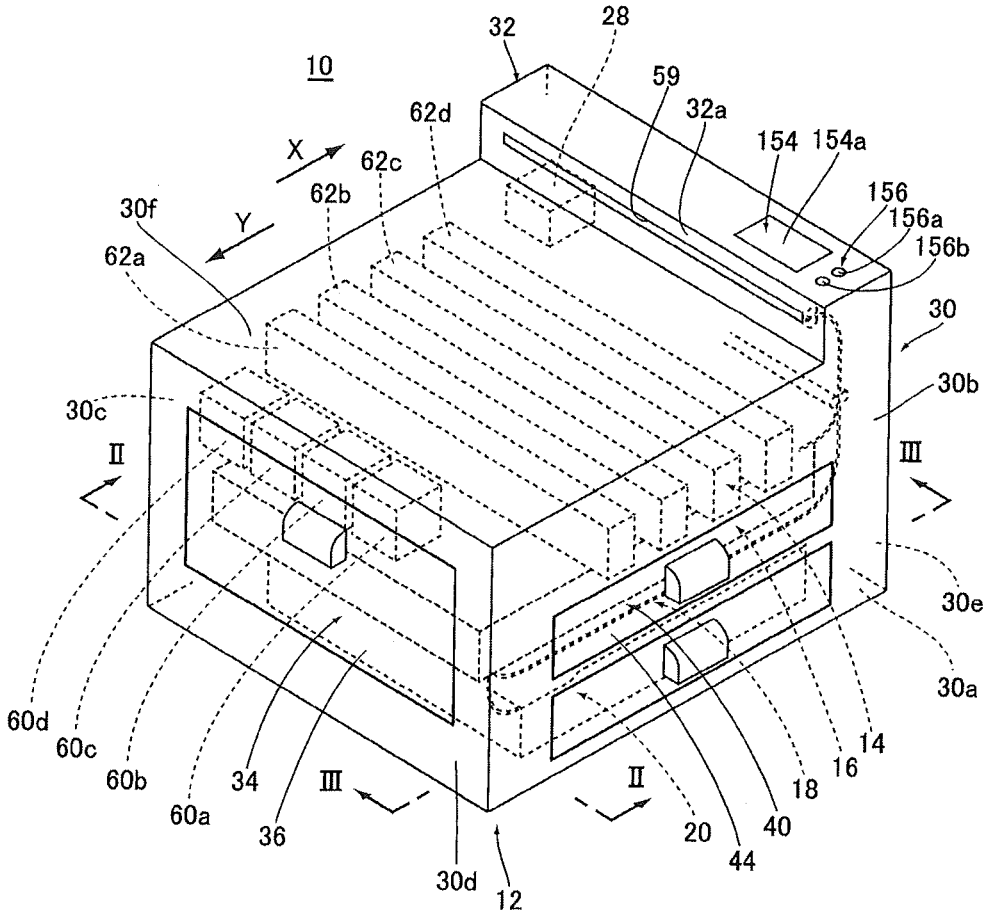
FIG. 1 is a perspective view illustrating the configuration of a recording apparatus according to an embodiment.
Figure 2:
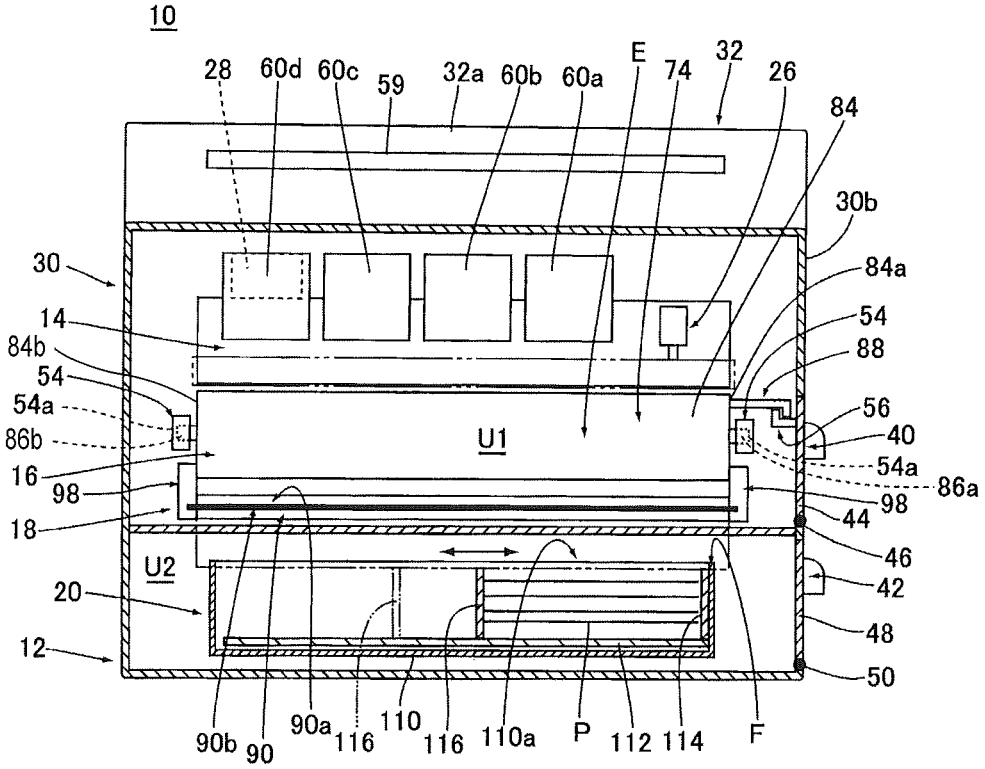
FIG. 2 is a cross-sectional view taken along line II-II in FIG. 1.
Figure 3:
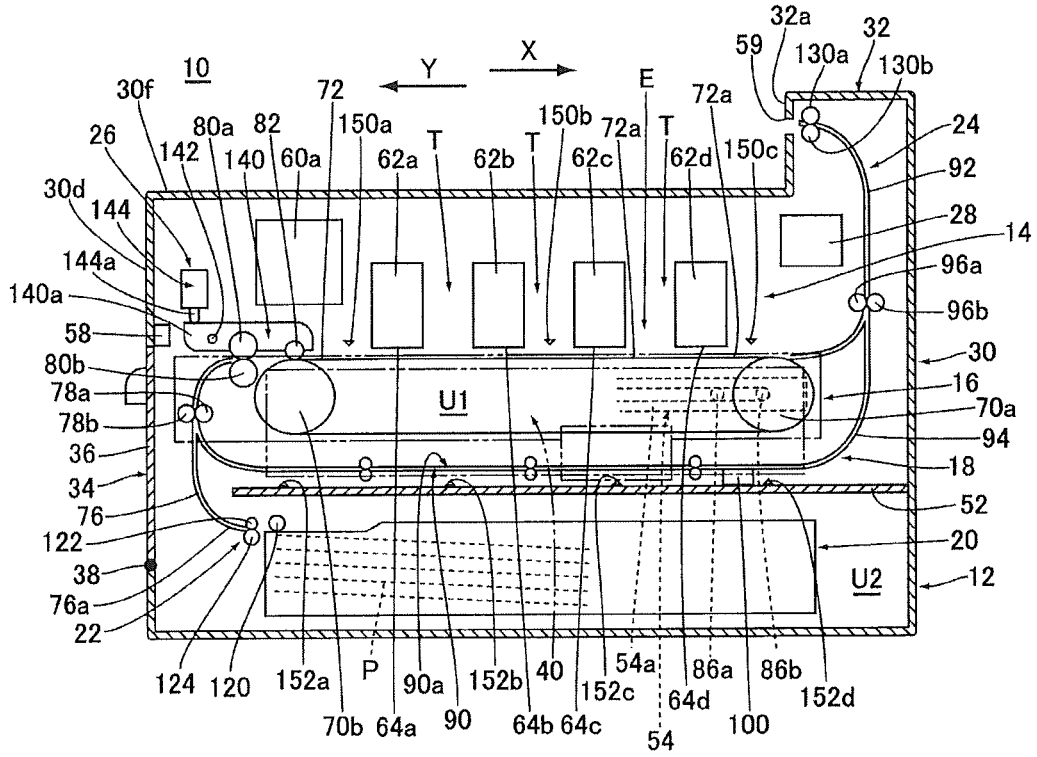
FIG. 3 is a cross-sectional view taken along line III-III in FIG. 1.

Referring to FIGS. 1 to 3, the recording apparatus 10 includes a casing 12. The casing 12 accommodates a recording head unit 14 that records an image on paper P; a conveying unit 16 that conveys the paper P to a position at which recording is performed in the recording head unit 14; a return path unit 18 that returns the paper P on which the image is recorded by the recording head unit 14 to the side of the conveying unit 16 upstream of the recording head unit 14; and a paper cassette 20 that accommodates the paper P, in this order from the top to the bottom.

Referring to FIG. 3, the casing 12 further accommodates a paper feeding unit 22 that supplies the paper P from the paper cassette 20 to the conveying unit 16; a paper output unit 24 that discharges the paper P from the conveying unit 16 onto the upper surface (top plate 30*f*) of the casing 12; a nip unit 26; and a control unit 28 that performs various controls on jam handling.

[Configuration of Casing]

Referring to FIGS. 1 to 3, the casing 12 has a substantially rectangular parallelepiped main body 30 and a substantially rectangular parallelepiped protruding portion 32 protruding upward from the upper surface of the main body 30.

Referring to FIG. 1, the main body 30 includes a bottom plate 30*a* that is substantially rectangular in plan view, four side walls 30*b* to 30*e* erecting from the peripheral edge of the bottom plate 30*a*, and a top plate 30*f*. The top plate 30*f* that constitutes the upper surface of the casing 12 functions as a paper output tray that receives the paper P discharged from the paper output unit 24.

Referring to FIG. 3, the side wall 30*d* that constitutes the left side of the casing 12 has a first drawing port 34 for drawing the conveying unit 16 and at least the upper portion 90*a* of a horizontal conveying path 90, to be described later, to the outside. The lower inner edge of the first drawing port 34 is fitted with a first cover 36 that opens and closes the first drawing port 34 using a first hinge 38. Referring to FIG. 2, the side wall 30*b* that constitutes the front face of the casing 12 has an opening 40 through which a hand is inserted into the casing 12 and a second drawing port 42 through which the paper cassette 20 is to be drawn out, which are arranged vertically. The lower inner edge of the opening 40 is fitted with a second cover 44 that opens and closes the opening 40 using a second hinge 46. The lower inner edge of the second drawing port 42 is fitted with a third cover 48 that opens and closes the second drawing port 42 using a third hinge 50. The opening 40 and the second drawing port 42 may be formed as one continuous opening.

Referring to FIGS. 2 and 3, the main body 30 has therein a plate-like receiving member 52 that receives the paper P that has fallen from the conveying unit 16, ink that has dropped from the recording head unit 14, and so on. A region above the receiving member 52 functions as an upper region U1 that accommodates the recording head unit 14, the conveying unit 16, and the return path unit 18. A region below the receiving member 52 functions as a lower region U2 that accommodates the paper cassette 20. The upper region U1 is provided with a guide rail 54 that guides the conveying unit 16 and at least the upper portion 90*a* of the horizontal conveying path 90 in parallel to a paper-P conveying direction (hereinafter referred to as a "conveying direction X"). Furthermore, referring to FIG. 2, the inner surface of the second cover 44 has a substantially L-shaped first locking portion 56 that locks the second cover 44 in a closed state. Referring to FIG. 3, a cover sensor 58 that senses whether the first cover 36 has opened is disposed in the vicinity of the first drawing port 34 in the casing 12.

Referring to FIG. 3, the protruding portion 32 has a side wall 32*a* that erects from the edge of the top plate 30*f* functioning as the paper output tray. The side wall 32*a* has a long-hole paper output port 59, extending in parallel to the top plate 30*f*, for outputting the paper P conveyed in the paper output unit 24 onto the upper surface (top plate 30*f*) of the casing 12.

In the foregoing description, of directions parallel to the conveying direction X, a direction in which the conveying unit 16 is drawn out is referred to as a "drawing direction Y".

[Recording Head Unit]

Referring to FIGS. 1 and 3, the recording head unit 14 is a unit that records an image on the paper P on the basis of image data given from an image input unit (not shown), such as a personal computer, and includes a plurality of (in this embodiment, four) ink cartridges 60*a* to 60*d* (see FIG. 1) that accommodate different colors (in this embodiment, four colors of cyan, yellow, magenta, and black) of ink; a plurality of (in this embodiment, four) inkjet recording heads 62*a* to 62*d* that eject the ink supplied from the ink cartridges 60*a* to 60*d* toward the paper P; and ink tubes (not shown) through which the ink in the ink cartridges 60*a* to 60*d* is supplied to the inkjet recording heads 62*a* to 62*d*, respectively.

Referring to FIG. 1, the individual inkjet recording heads 62*a* to 62*d* are line recording heads extending in a direction perpendicular to the conveying direction X. Referring to FIG. 3, the inkjet recording heads 62*a* to 62*d* have ejecting surfaces 64*a* to 64*d* each having a plurality of ink ejection ports (not shown), respectively. The inkjet recording heads 62*a* to 62*d* are arranged in parallel to the conveying direction X to form "columns" in such a manner that the ejecting surfaces 64*a* to 64*d* are horizontal.

[Conveying Unit]

Referring to FIG. 3, the conveying unit 16 includes two rollers 70*a* and 70*b* arranged in parallel to each other at a certain interval therebetween in a direction parallel to the conveying direction X; a conveying belt 72 stretched in a ring shape between the two rollers 70*a* and 70*b*; a holder 74 (see FIGS. 5A and 5B) that holds them; a paper feed path 76 that guides the paper P accommodated in the paper cassette 20 to the conveying belt 72; a pair of conveying rollers 78*a* and 78*b*; a pair of belt upstream rollers 80*a* and 80*b*; and a belt pinch roller 82.

The rollers 70*a* and 70*b* are columnar members that rotatably support the conveying belt 72. An output shaft of a motor (not shown) disposed in the casing 12 is detachably connected to at least one of the rotation shafts of the rollers 70*a* and 70*b* via a coupling. Specifically, when the conveying unit 16 is positioned at a position in the casing 12 at which a recording operation is executed (hereinafter referred to as a "recording position E"), at least one of the rotation shafts of the rollers 70*a* and 70*b* is connected to the output shaft of the motor, and when the conveying unit 16 is drawn out of the casing 12, the rotation shaft is disconnected from the output shaft of the motor.

The conveying belt 72 is an endless belt having a holding surface 72*a* that holds the paper P. In the casing 12, the holding surface 72*a* facing upward is disposed horizontally to oppose the ejecting surfaces 64*a* to 64*d*. Accordingly, when the conveying belt 72 is rotated by the motor, the paper P placed on the holding surface 72*a* is conveyed horizontally in sequence to positions opposing the ejecting surfaces 64*a* to 64*d* (that is, positions at which recording is performed).

Figure 4A:
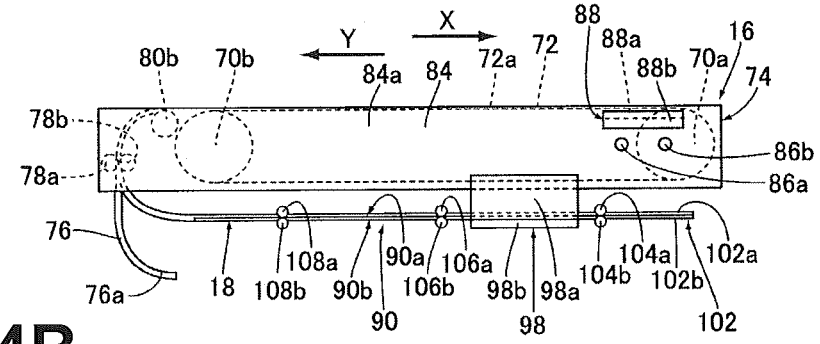
FIG. 4A is a front view illustrating a state in which the whole of a horizontal conveying path is drawn out together with a conveying unit.

Referring to FIG. 4A, the holder 74 is a support member that supports the rollers 70*a* and 70*b* and the conveying belt 72 while holding the mutual positional relationship thereof and includes a box-shaped holder main body 84 having an opening (not shown) at the top. The paper feed path 76, the pair of conveying rollers 78*a* and 78*b*, and the lower belt upstream roller 80*b* are mounted to the holder main body 84.

Referring to FIGS. 2 and 4A, two guide rollers 86*a* and 86*b* to be fitted in a long hole 54*a* formed in the guide rail 54 are disposed, with a certain distance therebetween in a direction perpendicular to the drawing direction Y, at one side 84*a* and the other side 84*b* of the holder main body 84 in the direction parallel to the drawing direction Y. Furthermore, referring to FIG. 2, a substantially L-shaped second locking portion 88, which is locked to the first locking portion 56 when the conveying unit 16 is positioned at the recording position E in the casing 12, is disposed at the side 84*a* of the holder main body 84.

Referring to FIGS. 2 and 3, the conveying direction X and the drawing direction Y in this embodiment are parallel to the horizontal surface, and the direction in which the long hole 54*a* extends is also parallel to the horizontal surface. Accordingly, since the two guide rollers 86*a* and 86*b* are fitted in the long hole 54*a* of the guide rail 54, the recording head unit 14 can be moved along the long hole 54*a* while holding the ejecting surfaces 64*a* to 64*d* horizontally.

Figure 5A:
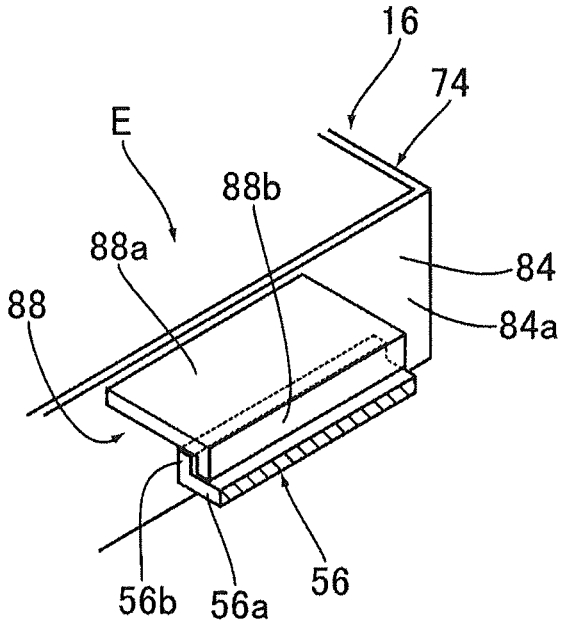
FIG. 5A is a perspective view illustrating a state in which a cover provided on an opening is locked.
Figure 5B:
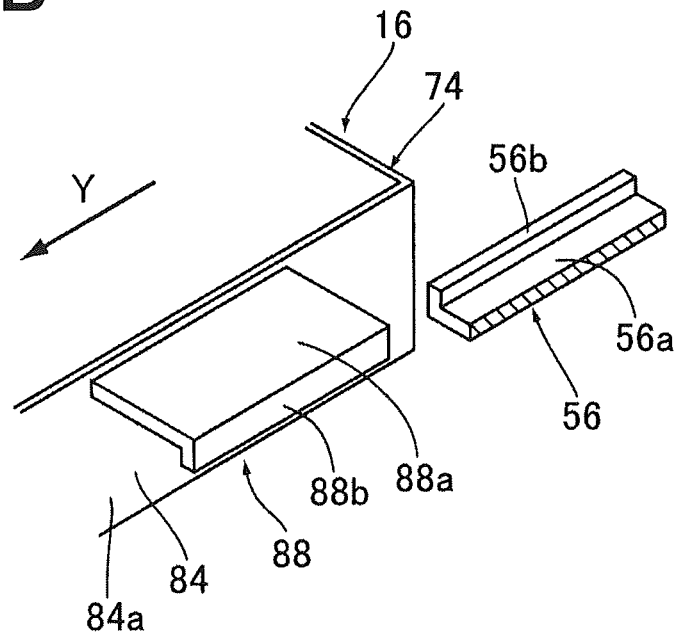
FIG. 5B is a perspective view illustrating a state in which the cover is unlocked.

Referring to FIG. 5A, when the conveying unit 16 is positioned at the recording position E, a locking piece 56*b* extending upward from a leg 56*a* of the first locking portion 56 and a locking piece 88*b* extending downward from a leg 88*a* of the second locking portion 88 can come into engagement, thereby inhibiting the opening action of the second cover 44 (see FIG. 2) that closes the opening 40. On the other hand, referring to FIG. 5B, when the conveying unit 16 is drawn from the recording position E, the engagement of the locking piece 56*b* and the locking piece 88*b* is released to allow the opening action of the second cover 44 (see FIG. 2). In other words, in this embodiment, the first locking portion 56 and the second locking portion 88 function as the "locking unit" that locks the second cover 44 in a closed state, and the mechanism that draws out the conveying unit 16 (including the guide rail 54) functions as an "unlocking mechanism" that releases the locking state.

[Return Path Unit]

Figure 4B:
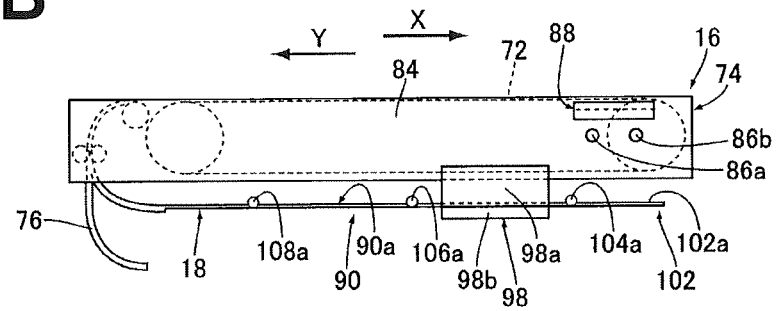
FIG. 4B is a front view illustrating a state in which only the upper portion of the horizontal conveying path is drawn out together with the conveying unit.

Referring to FIG. 3, the return path unit 18 is a unit for returning the paper P on which an image is recorded by the recording head unit 14 to the side of the conveying unit 16 upstream of the recording head unit 14 to record an image again on the paper P. The return path unit 18 is disposed below the conveying unit 16. The return path unit 18 includes the horizontal conveying path 90 that conveys the paper P in the horizontal direction; a connecting path 94 that connects a paper output path 92 of the paper output unit 24 and the horizontal conveying path 90; reversing rollers 96*a* and 96*b* provided at the junction of the paper output path 92 and the connecting path 94; a support unit 98 (see. FIGS. 4A and 4B) that supports the horizontal conveying path 90; and a fixing portion 100 that fixes the horizontal conveying path 90.

Referring to FIG. 4A, the horizontal conveying path 90 is defined by the upper portion 90*a* and a lower portion 90*b*. The upper portion 90*a* has an upper wall 102*a* that constitutes the upper surface of a horizontal path 102 through which the paper P is passed and a plurality of (in this embodiment, three) upper conveying rollers 104*a*, 106*a*, and 108*a* disposed with a certain distance therebetween in a direction parallel to the conveying direction X so as to be in contact with the upper surface of the paper P positioned in the horizontal path 102. On the other hand, the lower portion 90*b* has a lower wall 102*b* that constitutes the lower surface of the horizontal path 102 and lower conveying rollers 104*b*, 106*b*, and 108*b* disposed so as to oppose the upper conveying rollers 104*a*, 106*a*, and 108*a*, respectively, and to be in contact with the lower surface of the paper P positioned in the horizontal path 102.

The upper wall 102*a* of the upper portion 90*a* is formed so as to continue to the paper feed path 76 and to be separable from the connecting path 94. On the other hand, the lower wall 102*b* of the lower portion 90*b* is formed so as to be separable from both the paper feed path 76 and the connecting path 94. Accordingly, this embodiment allows a choice between a form, referring to FIG. 4A, in which both the upper portion 90*a* and the lower portion 90*b* are drawn out of the casing 12 together with the conveying unit 16 (hereinafter referred to as a "first form" and a form, referring to FIG. 4B, in which only the upper portion 90*a* is drawn out of the casing 12 together with the conveying unit 16 (hereinafter referred to as a "second form").

Referring to FIGS. 4A and 4B, the support unit 98 is integrally disposed at the holder 74 of the conveying unit 16. In the "first form", the support unit 98 supports both the upper portion 90*a* and the lower portion 90*b* and, in the "second form", supports only the upper portion 90. The support unit 98 has a first support portion 98*a* that fixedly supports the upper portion 90*a* and a second support portion 98*b* that detachably supports the lower portion 90*b*.

Referring to FIG. 3, the fixing portion 100 is integrally disposed at the receiving member 52. In the "first form", the fixing portion 100 releases the fixed state of the lower portion 90*b* and, in the "second form", fixes the lower portion 90*b* in the casing 12. The fixing portion 100 has a support mechanism (not shown) that detachably supports the lower portion 90*b*. The support unit 98 and the fixing portion 100 of this embodiment are configured to be driven by a solenoid or the like and are electrically connected to the control unit 28 through an electrical wire.

In the state in which the conveying unit 16 and the return path unit 18 are accommodated in the casing 12, referring to FIG. 3, the inner edge of the lower end of the opening 40 is positioned lower than the uppermost portion of the horizontal conveying path 90 of the return path unit 18, and the inner edge of the upper end of the opening 40 is positioned higher than the lowermost portion of the conveying unit 16. In this embodiment, since the upper portion 90*a* of the horizontal conveying path 90 has the upper conveying rollers 104*a*, 106*a*, and 108*a*, and the conveying unit 16 has the ring-shaped conveying belt 72, the inner edge of the lower end of the opening 40 is positioned the same or lower in height than the uppermost portions of the upper conveying rollers 104*a*, 106*a*, and 108*a*, and the inner edge of the upper end of the opening 40 is positioned higher than the holding surface 72*a*, facing downward, of the conveying belt 72. This widens the inner space of the casing 12 into which the hand is to be inserted, thus allowing the paper P left in the casing 12 to be easily taken out of the opening 40. Furthermore, in this embodiment, the inner edge of the upper end of the opening 40 is positioned lower than the ejecting surfaces 64*a* to 64*d*, thus preventing a hand from touching the ejecting surfaces 64*a* to 64*d*.

[Paper Cassette]

Referring to FIG. 2, the paper cassette 20 includes a box-shaped cassette main body 110 having an opening 110*a* in the upper surface; a paper receiving portion 112 that is disposed at the bottom of the cassette main body 110 and that is lifted up by a coil spring or the like (not shown); a positioning portion 114 that is secured in the cassette main body 110 and that is in contact with the side edge of the paper P adjacent to the opening 40 to define the position the paper P; and a guide 116 that is disposed so as to be adjustable in the direction perpendicular to the conveying direction X and that guides the side edge of the paper P opposite the opening 40. Accordingly, in the paper cassette 20, the side edge of the paper P adjacent to the opening 40 is positioned at a predetermined reference position F by the positioning portion 114 irrespective of the size of the paper P. When the paper P is supplied to the conveying unit 16 through the paper feeding unit 22, the paper P is positioned along the side edge of the holding surface 72*a* adjacent to the opening 40.

[Configurations of Paper Feeding Unit and Paper Output Unit]

Referring to FIG. 3, the paper feeding unit 22 supplies the paper P accommodated in the paper cassette 20 to the paper feed path 76 of the conveying unit 16. The paper feeding unit 22 includes a pickup roller 120, a paper feed roller 122, and a separation roller 124. When the conveying unit 16 is positioned at the recording position E in the casing 12, an upstream end 76*a* of the paper feed path 76 is positioned downstream of the paper feed roller 122 and the separation roller 124, thus allowing the paper P to be conveyed to the conveying unit 16. On the other hand, the paper output unit 24 includes a paper output path 92 and paper eject rollers 130*a* and 130*b*. A downstream end of the paper output path 92 is communicated with the paper output port 59.

[Nip Unit]

Referring to FIG. 3, the nip unit 26 nips the paper P between the belt upstream rollers 80*a* and 80*b* and between the belt pinch roller 82 and the conveying belt 72. The nip unit 26 includes a main body 140 that holds the belt upstream roller 80*a* and the belt pinch roller 82; a rotation shaft 142 that rotatably supports the main body 140; and a solenoid 144 that rotates the main body 140. An output portion 144*a* of the solenoid 144 is connected to an end 140*a* of the main body 140.

When the nip unit 26 is driven, the end 140*a* of the main body 140 is raised together with the output portion 144*a* of the solenoid 144 to rotate the main body 140 about the rotation shaft 142. Thus, the belt upstream roller 80*a* and the belt pinch roller 82 held by the main body 140 are moved downward to nip the paper P.

[Control Unit Etc.]

Figure 6:
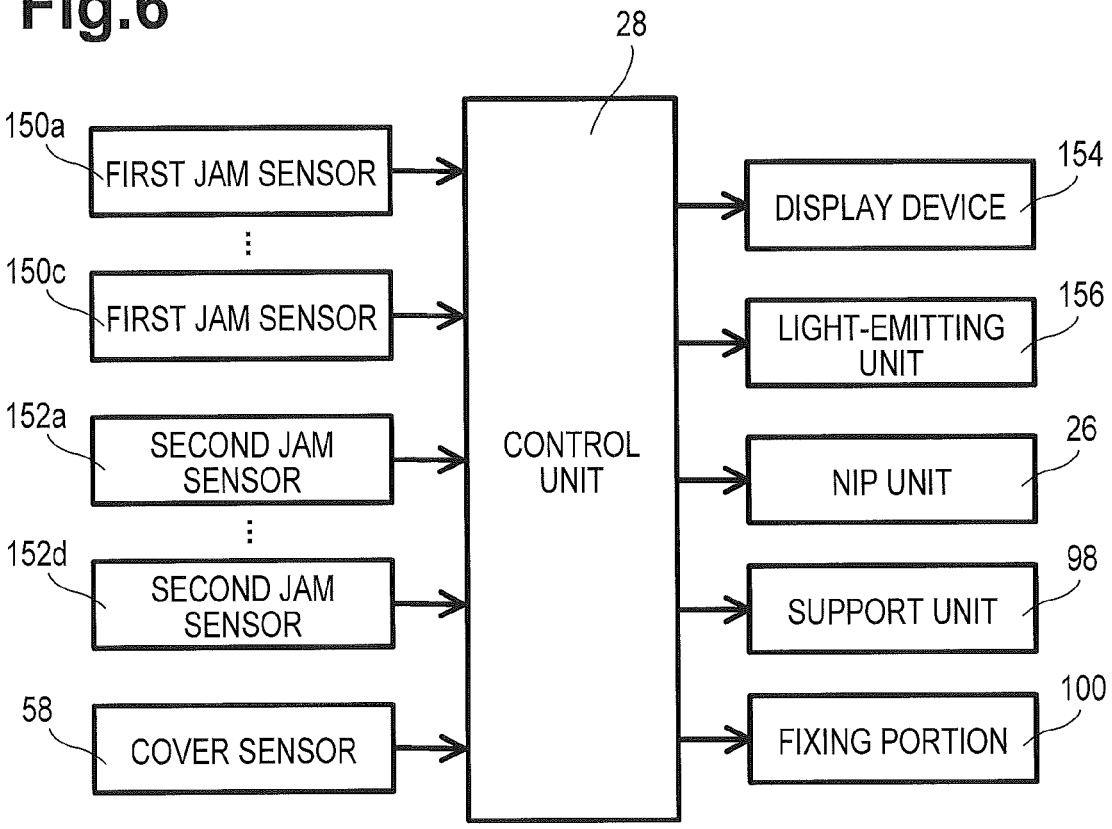
FIG. 6 is a block diagram illustrating the configuration of the recording apparatus according to the embodiment.

Referring to FIG. 6, the control unit 28 executes various controls on jam handling; specifically, the control unit 28 includes a central processing unit (CPU) that executes various arithmetic operations and storage units (ROM and RAM) that store various kinds of data. The control unit 28 is connected to first jam sensors 150*a* to 150*c*, second jam sensors 152*a* to 152*d*, the cover sensor 58, a display device 154, a light-emitting unit 156, the nip unit 26, the support unit 98, and the fixing portion 100.

Referring to FIG. 3, the first jam sensors 150*a* to 150*c* detect the occurrence of a jam in the conveying unit 16. Specifically, the first sensors 150*a* to 150*c* are paper sensors opposed to the holding surface 72*a* facing upward. On the other hand, the second jam sensors 152*a* to 152*d* detect the occurrence of a jam in the horizontal conveying path 90. Specifically, the second jam sensors 152*a* to 152*d* are paper sensors opposed to the horizontal path 102.

The individual first jam sensors 150*a* to 150*c* and second jam sensors 152*a* to 152*d* are configured to be able to detect the presence or absence of the paper P in their detection regions. Accordingly, if the time from the time at which one jam sensor detects the paper P until the time at which the jam sensor no longer detects the paper P is excessively long, the control unit 28 can determine that a jam has occurred in the detection region of the jam sensor. If the time from the time at which one upstream jam sensor detects the paper P until the time at which a downstream jam sensor detects the paper P is excessively long, the control unit 28 can determine that a jam has occurred in the detection regions of the jam sensors. A method for detecting the occurrence of a jam is not particularly limited and may be selected from known arts.

The control unit 28 outputs a "first signal" indicating that "both the upper portion 90*a* and the lower portion 90*b* should be drawn out together with the conveying unit 1", when the first jam sensors 150*a* to 150*c* detect "a jam in the "conveying unit 16". The control unit 28 outputs a "second signal" indicating that "only the upper portion 90*a* should be drawn out together with the conveying unit 16", when the second jam sensors 152*a* to 152*d* detect "a jam in the horizontal conveying path 90". The display device 154, the light-emitting unit 156, the support unit 98, and the fixing portion 100 are controlled on the basis of the "first signal" and the "second signal" output from the control unit 28.

Referring to FIG. 1, the display device 154 includes a display panel 154*a* disposed on the upper surface of the casing 12. The display device 154 is configured, when the "first signal" is input, to output an image indicating that "both the upper portion 90*a* and the lower portion 90*b* should be drawn out together with the conveying unit 16" to the display panel 154*a*, and when the "second signal" is input, to output an image indicating that "only the upper portion 90*a* should be drawn out together with the conveying unit 16" to the display panel 154*a*.

Referring to FIG. 1, the light-emitting unit 156 includes lamps 156*a* and 156*b* that are disposed on the upper surface of the casing 12 and that emit different colors of light. The light-emitting unit 156 is configured, when the "first signal" is input, to output light (for example, red light) indicating that "both the upper portion 90*a* and the lower portion 90*b* should be drawn out together with the conveying unit 16" from the lamp 156*a*, and when the "second signal" is input, to output light (for example, blue light) indicating that "only the upper portion 90*a* should be drawn out together with the conveying unit 16" from the lamp 156*b*.

Referring to FIGS. 4A and 4B, the support unit 98 is configured, when the "first signal" is input, to support both the upper portion 90*a* and the lower portion 90*b*, and when the "second signal" is input, to support only the upper portion 90*a*.

Figure 8A:
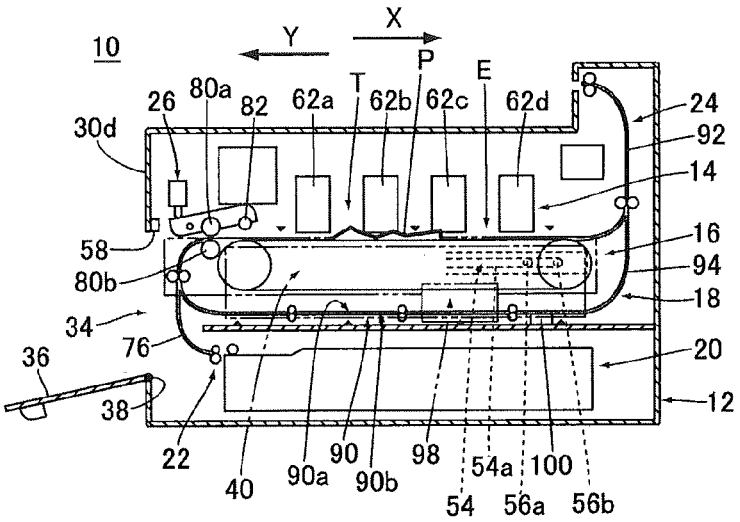
FIG. 8A is a cross-sectional view illustrating the process of opening a drawing port.
Figure 8B:
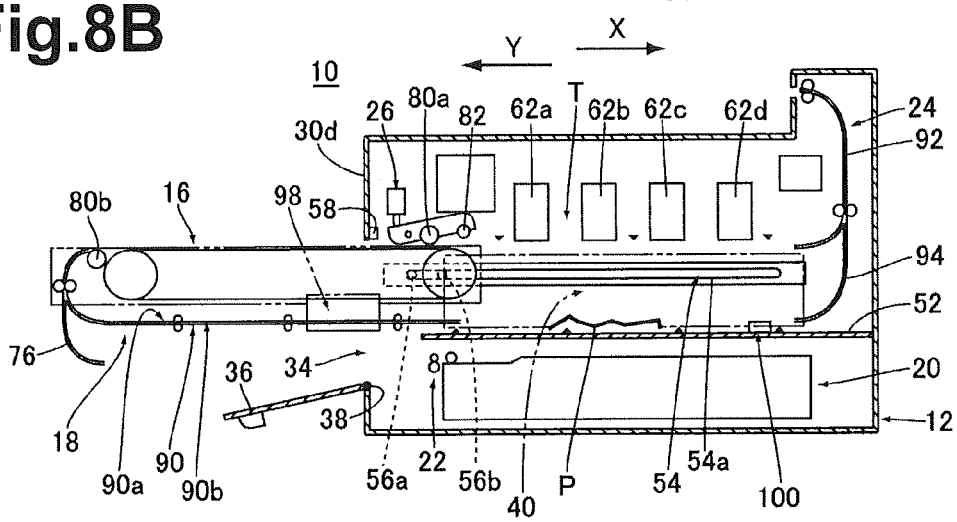
FIG. 8B is a cross-sectional view illustrating the process of drawing out the whole horizontal conveying path together with the conveying unit.
Figure 8C:
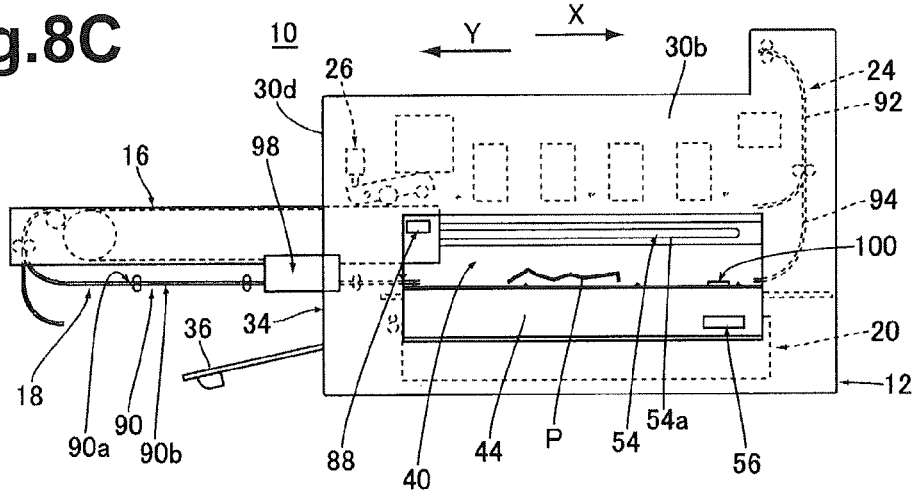
FIG. 8C is a front view illustrating the process of removing paper through the opening.

Referring to FIGS. 8A to 8C, the fixing portion 100 is configured, when the "first signal" is input, to release the fixed state of the lower portion 90*b*, and when the "second signal" is input, to fix the lower portion 90*b*.

[Recording Operation]

Referring to FIG. 3, when an image is to be recorded on one side of the paper P using the recording apparatus 10, the conveying unit 16 is positioned at the recording position E, the paper P is accommodated in the paper cassette 20, and the position of the paper P is defined by the positioning portion 114 (see FIG. 2).

When a recording operation is started, the paper P accommodated in the paper cassette 20 is fed to the holding surface 72*a* of the conveying unit 16 through the paper feed path 76 and is conveyed to positions opposing the ejecting surfaces 64*a* to 64*d* by the conveying belt 72. Since ink is ejected from the plurality of ink ejection ports (not shown), an image is recorded on the surface of the paper P. The paper P on which the image is recorded is discharged onto the top plate 30*f* through the paper output path 92. Furthermore, when an image is to be recorded also on the other side of the paper P, the paper P on which the image is recorded by the recording head unit 14 is conveyed from the paper output path 92 to the connecting path 94 of the return path unit 18 by rotating the reversing rollers 96*a* and 96*b* in the opposite direction and is returned to the side of the conveying unit 16 upstream of recording head unit 14 through the horizontal conveying path 90.

[Jam Handling Operation]

Figure 7:
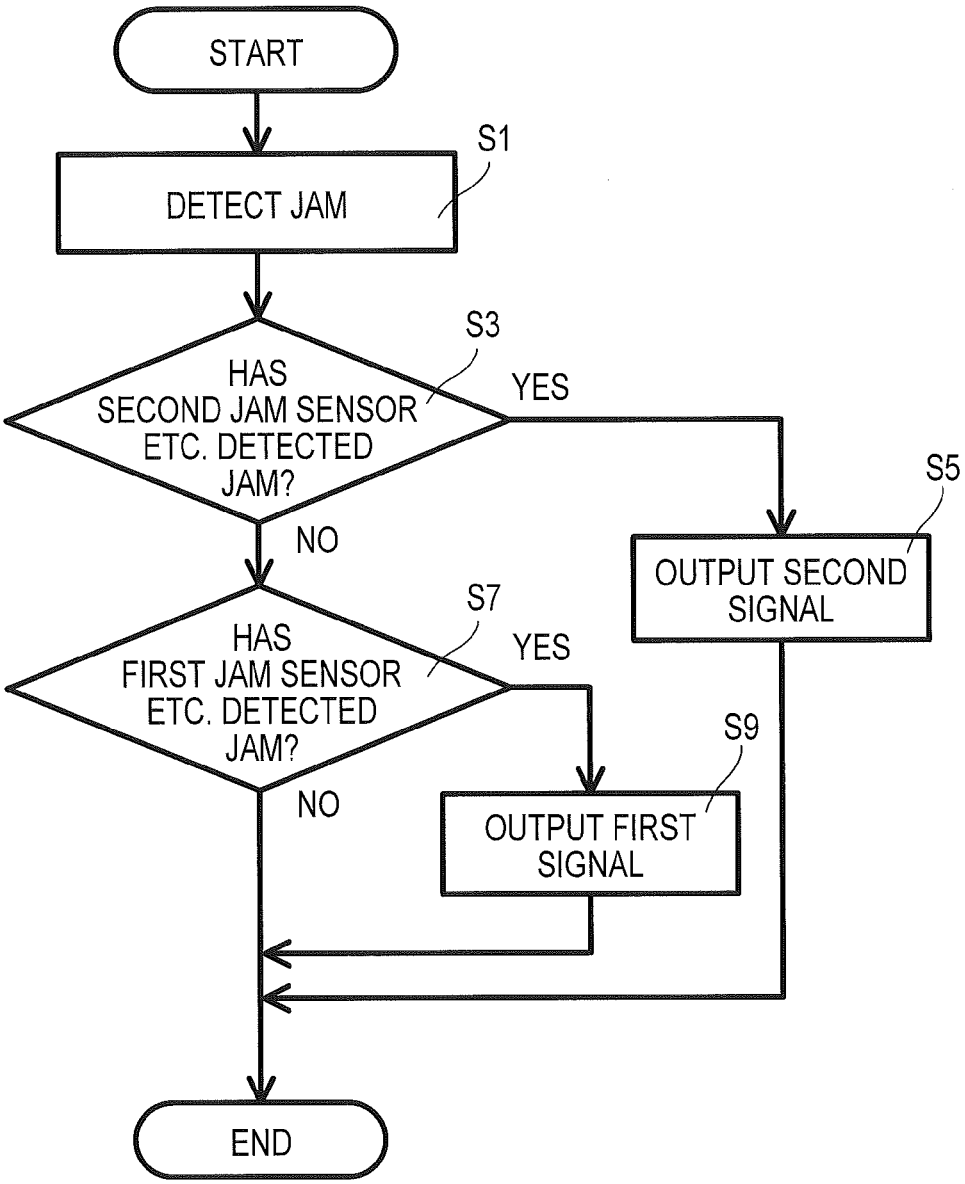
FIG. 7 is a flowchart illustrating the jam handling operation of the recording apparatus according to the embodiment.

Referring to FIG. 7, when the jam detecting operation of the control unit 28 is started, first, in step S1, the jam detecting operation of the first jam sensors 150*a* to 150*c*, the second jam sensors 152*a* to 152*d*, and the control unit 28 is executed. In step S3, it is determined whether the second jam sensors 152*a* to 152*d* etc. have detected "a jam in the horizontal conveying path 90". If it is determined to be "YES", then the "second signal" is output from the control unit 28 in step S5. In contrast, if it is determined to be "NO", then it is determined in step S7 whether the first jam sensors 150*a* to 150*c* etc. have detected "a jam in the conveying unit 16". If it is determined to be "YES", then the "first signal" is output from the control unit 28 in step S9.

Referring to FIG. 8A, when it is seen using the display device 154 and the light-emitting unit 156 that the "first signal" was output in step S9, the user first brings down the first cover 36 that closes the first drawing port 34 to open the first drawing port 34. Then, it is detected by the cover sensor 58 that the first cover 36 is opened, and together with it, current supply to the nip unit 26 is stopped by the control unit 28, such that the nip unit 26 releases the nip of the paper P. At that time, the support unit 98 and the fixing portion 100 are driven in response to the "first signal", such that both the upper portion 90*a* and the lower portion 90*b* are supported by the support unit 98, and the fixed state of the lower portion 90*b* is released by the fixing portion 100.

Subsequently, referring to FIG. 8B, the conveying unit 16 and the horizontal conveying path 90 (the upper portion 90*a* and the lower portion 90*b*) are drawn out of the casing 12 through the first drawing port 34. If the paper P is placed on the holding surface 72*a* of the conveying unit 16, the paper P is removed at the outside of the casing 12. Referring to FIG. 8C, if the paper P placed on the holding surface 72*a* falls into the casing 12 when the conveying unit 16 etc. are drawn out, the second cover 44 is brought down to open the opening 40, and the paper P is removed by inserting a hand into the casing 12 through the opening 40.

On the other hand, when the "second signal" is output in step S5, the support unit 98 and the fixing portion 100 are driven in response to the "second signal", such that only the upper portion 90*a* of the horizontal conveying path 90 is supported by the support unit, and the lower portion 90*b* is fixed by the fixing portion 100. Accordingly, referring to FIG. 9, the conveying unit 16 is thereafter drawn out of the casing 12, the lower portion 90*b* is left in the casing 12, thus allowing the paper P placed on the lower portion 90*b* to be easily removed through the opening 40.

Figure 9:
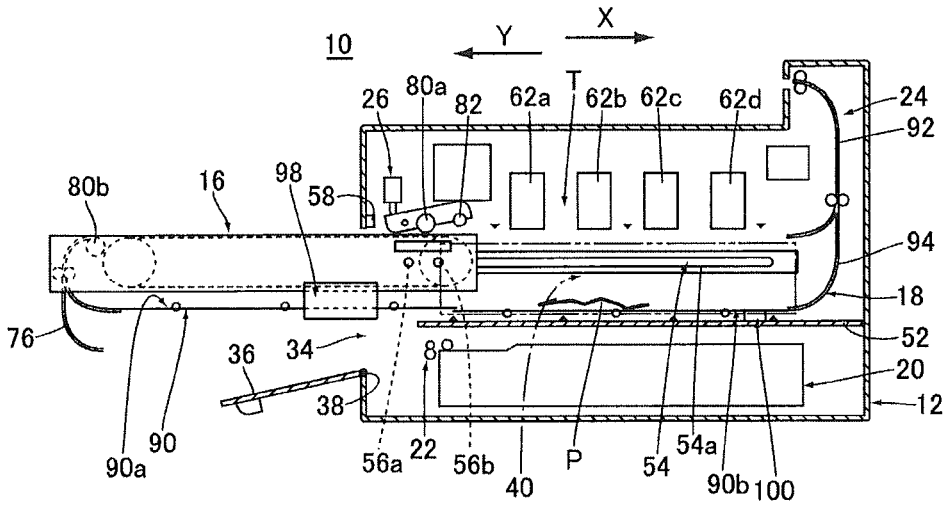
FIG. 9 is a cross-sectional view illustrating, of the jam handling method of the recording apparatus according to the embodiment, the process of drawing only the upper portion of the horizontal conveying path together with the conveying unit.

Referring to FIGS. 8B and 9, in this embodiment, the drawing direction Y is parallel to the conveying direction X, such that the conveying unit 16 and at least the upper portion 90*a* of the horizontal conveying path 90 are drawn out parallel to the direction of the "columns" of the inkjet recording heads 62*a* to 62*d*. Accordingly, when jam handling is performed through the opening 40, all of the inkjet recording heads 62*a* to 62*d* and regions T positioned therebetween can be viewed through the opening 40. This allows the paper P jammed in the regions T to be easily removed through the opening 40 also owing to the wide space in the casing 12 into which the hand can be inserted.

Furthermore, referring to FIG. 2, when the paper P is positioned at the opening 40 side in the paper cassette 20, and when the paper P is supplied to the conveying unit 16, the paper P is positioned along the edge of the holding surface 72*a* adjacent to the opening 40. Therefore, the paper P that is jammed in the conveying unit 16 and the horizontal conveying path 90 is positioned near the opening 40. Accordingly, even if the paper P is left in the casing 12, the paper P can be easily removed through the opening 40. Referring to FIGS. 8B and 9, since the paper P left in the casing 12 can be received by the receiving member 52 or the lower portion 90*b* positioned above the paper cassette 20, the paper P stained with ink does not come into contact with the paper P accommodated in the paper cassette 20, thus preventing the paper P in the paper cassette 20 from being stained.

Referring to FIG. 5A, since the first locking portion 56 and the second locking portion 88 lock the second cover 44 in a closed state, the second cover 44 can be prevented from being opened while the conveying unit 16 is performing a conveying operation.

Furthermore, referring to FIG. 7, the detection of "a jam in the horizontal conveying path 90" by the second jam sensors 152*a* to 152*d* etc. is performed before the detection of "a jam in the conveying unit 16" by the first jam sensors 150*a* to 150*c* etc.; therefore, if jams have occurred both in the conveying unit 16 and the horizontal conveying path 90, the upper portion 90*a* of the horizontal conveying path 90 can be drawn out together with the conveying unit 16 in response to the "second signal", thus allowing the paper P to be removed from both the conveying unit 16 and the horizontal conveying path 90.

Other Embodiments

Although the embodiment described above is configured such that the conveying unit 16 and the upper portion 90*a* of the horizontal conveying path 90 are integrally formed and are drawn out at the same time, they may be separably formed and may be separately drawn out. The upper portion 90*a* and the lower portion 90*b* of the horizontal conveying path 90 may be integrally formed so as not to be separated. Also in those cases, at least the upper portion 90*a* of the horizontal conveying path 90 can be drawn out of the casing 12 together with the conveying unit 16 or separately, which increases the space in the casing 12 into which the hand is to be inserted, thus allowing the paper P left in the casing 12 to be easily removed through the opening 40.

Furthermore, the "drawing direction Y" in which the conveying unit 16 and at least the upper portion 90*a* of the horizontal conveying path 90 are drawn out should be a direction perpendicular to a direction in which the opening 40 faces. If the direction of the opening 40 is the "conveying direction X", the "drawing direction Y" may be a direction perpendicular to the "conveying direction X".

In the embodiment described above, the present invention is applied to the line inkjet printer; instead, the present invention may also be applied to serial inkjet printers, laser printers, facsimile machines, copying machines, etc. The method for conveying a recording medium is not limited to the "belt system" but may be a "roller system".

Furthermore, the "return path unit" is not limited to the path unit for printing both sides of the paper P; for example, it may be a path unit for printing on the same side of the paper P a plurality of times.

What is claimed is:

1. A recording apparatus comprising:

a recording unit configured to record an image on a recording medium;

a conveying unit disposed below the recording unit and configured to convey the recording medium to a first horizontal conveying path in a first horizontal conveying direction at a position at which recording is performed by the recording unit;

a return path unit configured to return the recording medium to a side of the conveying unit upstream of the recording unit to record an image again on the recording medium; and a casing which accommodates the recording unit, the conveying unit, and the return path unit, wherein the return path unit is disposed below the conveying unit and comprises a second horizontal conveying path parallel to the first horizontal conveying path in a second horizontal conveying direction and comprising an upper portion and a lower portion such that the recording medium only moves in one direction while in the second horizontal conveying path, wherein side walls of the casing comprise a drawing port through which the conveying unit and the upper portion of the second horizontal conveying path and the lower portion of the second horizontal conveying ring path are configured to be selectively drawn out of the casing in a drawing direction parallel to the first and second horizontal conveying directions in a first state where the conveying unit and the upper portion are drawn out while the lower portion of the second horizontal conveying path remains in the casing and in a second state where the conveying unit and the upper portion and the lower portion are drawn out together, and an opening facing in a direction perpendicular to the drawing direction thereof, and wherein an inner edge of a lower end of the opening is positioned the same or lower in height than an uppermost portion of the second horizontal conveying path in the return path unit.

2. The recording apparatus according to claim 1, wherein a holder of the conveying unit and at least the upper portion of the second horizontal conveying path are integrally formed.

3. The recording apparatus according to claim 1, wherein the upper portion and the lower portion are configured to be separated from each other; and wherein the recording apparatus further comprises a fixing unit configured to fix the lower portion in the casing when the conveying unit and the upper portion are drawn out through the drawing port.

4. The recording apparatus according to claim 3, further comprising:

a first jam detecting unit configured to detect an occurrence of a jam in the conveying unit;

a second jam detecting unit configured to detect an occurrence of a jam in the second horizontal conveying path; and an output unit, wherein when the first jam detecting unit detects a jam, the output unit outputs a first signal indicating that both the upper portion and the lower portion should be drawn out together with the conveying unit and the fixing unit does not fix the lower portion in the casing, and wherein when the second jam detecting unit detects a jam, the output unit outputs a second signal indicating that only the upper portion should be drawn out together with the conveying unit and the fixing unit fixes the lower portion in the casing.

5. The recording apparatus according to claim 1, wherein the recording unit comprises a plurality of inkjet recording heads; and wherein the plurality of inkjet recording heads are arranged parallel to the first and second horizontal conveying paths.

6. The recording apparatus according to claim 1, wherein an inner edge of an upper end of the opening is positioned higher than a lowermost portion of the conveying unit.

7. The recording apparatus according to claim 1, further comprising:

a cover configured to open and close the opening;

a locking unit configured to lock the cover in a closed state; and an unlocking mechanism configured to release the locking state of the locking unit when the conveying unit is drawn out through the drawing port.

8. The recording apparatus according to claim 1, further comprising:

a recording-medium accommodating unit disposed below the return path unit and configured to accommodate the recording medium, wherein the recording-medium accommodating unit comprises:

a positioning portion which is in contact with a side edge of the recording medium adjacent to the opening to define the position of the recording medium; and a guide which guides a side edge of the recording medium opposite the opening depending on a size of the recording medium.

9. The recording apparatus according to claim 8, further comprising a receiving member disposed between the return path unit and the recording-medium accommodating unit, and configured to receive a recording medium which has fallen from the conveying unit.

10. The recording apparatus according to claim 1, wherein the opening in the side walls provide access to a space below the recording unit when the conveying unit has been drawn out of the casing.

11. The recording apparatus according to claim 1, wherein the casing further accommodates a pair of reversing rollers in that operate during single-side printing and duplex printing on the recording medium such that:

during single-side printing, the reversing rollers rotate in a first direction and during duplex printing, the reversing rollers rotate in the first direction, then rotate in a direction opposite to the first direction, and then rotate in the first direction again.

12. A recording apparatus comprising:

a casing comprising a bottom plate and a plurality of side walls perpendicular to the bottom plate;

a recording unit configured to record an image on a recording medium;

a conveying unit disposed between the recording unit and the bottom plate and configured to convey the recording medium to a first horizontal conveying path in a first horizontal conveying direction parallel to the bottom plate at a position at which recording is performed by the recording unit; and a return path unit configured to return the recording medium to a side of the conveying unit upstream of the recording unit to record an image again on the recording medium, wherein the return path unit is disposed between the conveying unit and the bottom plate and comprises a second horizontal conveying path in a second horizontal conveying direction parallel to the bottom plate, wherein the second horizontal conveying path comprises an upper portion and a lower portion such that the recording medium only moves in one direction while in the second horizontal conveying path, wherein a first side wall of the casing comprises a drawing port through which the conveying unit and the upper portion of the second horizontal conveying path and the lower portion of the second horizontal conveying path are configured to be selectively drawn out of the casing in a drawing direction parallel to the first and second horizontal conveying directions in a first state where the conveying unit and the upper portion are drawn out, while the lower portion of the second horizontal conveying path remains in the casing and in a second state where the conveying unit and the upper portion and the lower portion are drawn out together, and a second side wall of the casing comprises an opening facing in a direction perpendicular to the drawing direction thereof, and wherein an inner edge of a lower end of the opening is positioned the same or lower in height than an uppermost portion of the second horizontal conveying path in the return path unit.

13. The recording apparatus according to claim 12, wherein a holder of the conveying unit and at least the upper portion of the second horizontal conveying path are integrally formed.

14. The recording apparatus according to claim 12, wherein the upper portion and the lower portion are configured to be separated from each other; and wherein the recording apparatus further comprises a fixing unit configured to fix the lower portion in the casing when the conveying unit and the upper portion are drawn out through the drawing port.

15. The recording apparatus according to claim 14, further comprising:

a first jam detecting unit configured to detect an occurrence of a jam in the conveying unit; and a second jam detecting unit configured to detect an occurrence of a jam in the second horizontal conveying path, wherein when the first jam detecting unit detects a jam, the fixing unit does not fix the lower portion in the casing, and wherein when the second jam detecting unit detects a jam, the fixing unit fixes the lower portion in the casing.

16. The recording apparatus according to claim 12, wherein the recording unit comprises a plurality of inkjet recording heads; and wherein the plurality of inkjet recording heads are arranged parallel to the first and second horizontal conveying paths.

17. The recording apparatus according to claim 12, wherein an inner edge of an upper end of the opening is positioned higher than a lowermost portion of the conveying unit.

18. The recording apparatus according to claim 12, further comprising:

a cover configured to open and close the opening;

a locking unit configured to lock the cover in a closed state; and an unlocking mechanism configured to release the locking state of the locking unit when the conveying unit is drawn out through the drawing port.

19. The recording apparatus according to claim 12, further comprising:

a recording-medium accommodating unit disposed below the return path unit and configured to accommodate the recording medium, wherein the recording-medium accommodating unit comprises:

a positioning portion which is in contact with a side edge of the recording medium adjacent to the opening to define the position of the recording medium; and a guide which guides a side edge of the recording medium opposite the opening depending on a size of the recording medium.

20. The recording apparatus according to claim 19, further comprising a receiving member disposed between the return path unit and the recording-medium accommodating unit, and configured to receive a recording medium which has fallen from the conveying unit.

21. The recording apparatus according to claim 12, wherein the opening in the side walls provide access to a space below the recording unit when the conveying unit has been drawn out of the casing.

22. The recording apparatus according to claim 12, wherein the casing further accommodates a pair of reversing rollers in that operate during single-side printing and duplex printing on the recording medium such that:

during single-side printing, the reversing rollers rotate in a first direction and during duplex printing, the reversing rollers rotate in the first direction, then rotate in a direction opposite to the first direction, and then rotate in the first direction again.

* * * * *